US005490692A

United States Patent [19]

Howard

[11] Patent Number: 5,490,692

[45] Date of Patent: Feb. 13, 1996

[54] LABEL/LEAFLETS

[75] Inventor: Robin G. Howard, Bury St. Edmunds, United Kingdom

[73] Assignee: Denny Bros. Printing Limited, Suffolk, United Kingdom

[21] Appl. No.: 128,721

[22] Filed: Sep. 30, 1993

[30] Foreign Application Priority Data

Oct. 1, 1992 [GB] United Kingdom ..... 9220720

[51] Int. Cl.[6] ..... B42D 19/00; B42D 15/00; B42D 1/00

[52] U.S. Cl. ..... 283/81; 281/5; 281/2; 283/101; 283/105; 40/306; 156/253

[58] Field of Search ..... 281/2, 5; 283/51, 283/61, 81, 100, 101, 105; 156/227, 253, 268, 270; 428/40, 43; 229/69, 70; 40/306, 625

[56] References Cited

U.S. PATENT DOCUMENTS

| | | | |
|---|---|---|---|
| 4,529,229 | 7/1985 | Glibbery | 283/75 X |
| 4,534,582 | 8/1985 | Howard | 281/18 X |
| 4,778,153 | 10/1988 | Bachman et al. | 283/106 X |
| 4,850,613 | 7/1989 | Instance | 283/62 X |
| 4,930,812 | 6/1990 | Howard | 281/5 |
| 5,127,676 | 7/1992 | Bockairo | 283/81 |
| 5,263,743 | 11/1993 | Jones | 283/105 X |
| 5,284,363 | 2/1994 | Gartner et al. | 283/81 |
| 5,290,616 | 3/1994 | Cowan et al. | 281/5 X |
| 5,308,119 | 5/1994 | Roshkoff | 283/105 X |
| 5,332,265 | 7/1994 | Groess et al. | 283/101 X |

*Primary Examiner*—Frances Han
*Attorney, Agent, or Firm*—Wenderoth, Lind & Ponack

[57] ABSTRACT

A leaflet/label includes a carrier sheet having adhesive on its rear face protected by a release sheet, and a leaflet attached to the front face of the carrier sheet. The leaflet has a first sheet folded about a fold line extending transversely of the sheet to provide a cover panel and a rear panel, and a second sheet folded about a fold line extending transversely of the sheet. The folded second sheet is enclosed between the cover and rear panels of the first sheet and with the fold line of the second sheet adjacent the fold lime of the first sheet. The two folded sheets are secured together face to face along one edge remote from the fold lines.

13 Claims, 4 Drawing Sheets

LABEL/LEAFLETS

BACKGROUND OF THE INVENTION

This invention relates to label/leaflets.

SUMMARY OF THE INVENTION

According to this invention in one aspect there is provided a leaflet/label comprising a carrier sheet having adhesive on its rear face protected by a release sheet, a leaflet attached to the front face of the carrier sheet, which leaflet comprises a first sheet folded about a first fold line extending transversely of the sheet to provide a cover panel and a rear panel, and a second sheet folded about a fold line extending transversely of the sheet, the folded second sheet being enclosed between the cover and rear panels of the first sheet and with the fold line of the second sheet adjacent the fold line of the first sheet, the two folded sheets being secured together face to face along one edge remote from the fold lines, and means whereby the transversely extending ends of the cover panel are secured to the carrier sheet such that the leaflet is held closed.

According to the invention in another aspect there is provided a method of making a leaflet/label comprising the steps of folding a printed leaflet along a transverse fold line intermediate its ends, bonding the two parts of the leaflet on opposite sides of the fold line together face to face along one edge extending at right angles to the fold line, slitting along the fold line, folding the superimposed parts along a second fold line parallel to the first fold line to form a first folded sheet enclosing a second folded sheet, securing the end of the enclosing sheet adjacent the fold lines to the front face of a carrier label, the rear face of which carries a pressure-sensitive adhesive protected by a release sheet, and securing the end of that panel of the leaflet which has the second folded sheet between it and the carrier label, which end is remote from the fold line to the front face of the carrier label such that the leaflet is held closed.

The invention also provides a method of producing a plurality of leaflet/labels mounted on a release sheet, comprising the steps of making a strip of leaflets by folding transversely of its length a leaflet sheet which hag two or more parallel bands of bonding extending from the fold line to a transverse edge of the leaflet sheet, whereby the resulting two leaves of the folded leaflet sheet are bonded together face to face by the bands of bonding, the leaflet sheet having been pre-printed with the content of each leaflet disposed between each adjacent pair of said parallel bands, or between one of said bands and a parallel edge of the sheet as the case may be, separating the Leaflet sheet into two leaves by cutting along the fold line, folding the two leaves along a second fold line parallel to the first said fold line so that one of the folded leaves encloses the other placing the resulting strip of leaflets on the front face of a strip of label material having on its rear face a pressure sensitive adhesive protected by the release sheet, the folded end of the strip being bonded to the front face of the label material and the end of that panel of the enclosing leaf which has the said other leaf between it and the label material, which end is remote from the fold lines, being secured to the front face of the label material such that the leaflet strip is held closed, die-cutting around each leaflet as for as the release sheet in a manner such that said leaflets include along only one edge thereof extending away from the fold lines a line of bonding from said bands respectively, and discarding the waste material.

BRIEF DESCRIPTION OF THE DRAWINGS

The invention will now be described in more detail with reference by way of example to the accompanying drawings in which.

DETAILED DESCRIPTION OF THE PREFERRED EMBODIMENTS

Figure 1A:
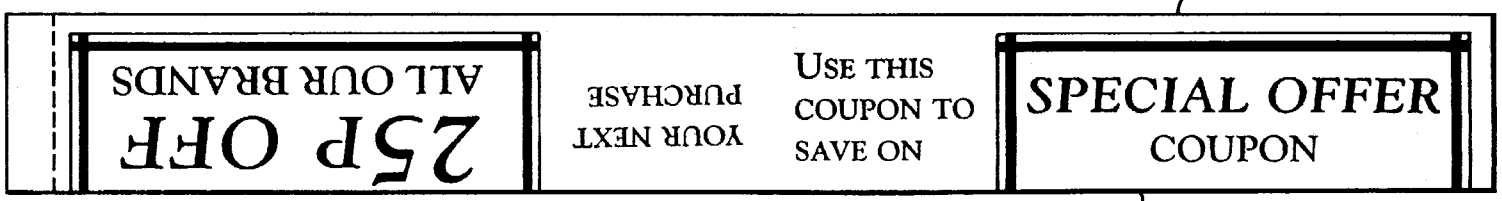
FIGS. 1A and 1B respectively show the two faces of an individual leaflet as printed
Figure 1B:
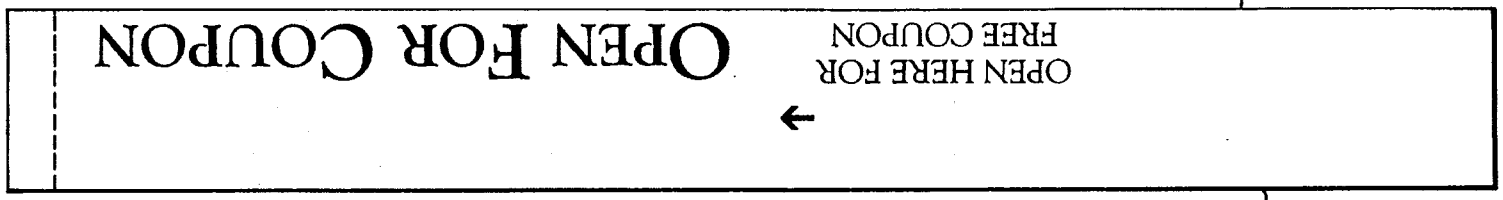

Referring first to FIGS. 1A and 1B there are shown the two faces of an individual elongate leaflet 10 which in this instance indicates a "special offer". The top edge of the final leaflet is indicated at 11 and the bottom edge at 12.

Figure 2:
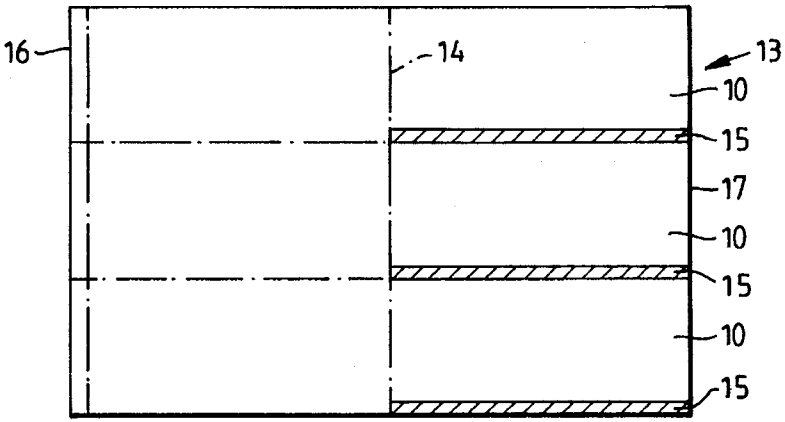
FIG. 2 shows a leaflet sheet comprising thread leaflets FIGS. 3 to 6 respectively indicate subsequent stages of the method according to the invention

Referring now to FIG. 2, the front face of a printed leaflet strip 13 is shown which provides three leaflets 10 one above the other, each extending across substantially the full width of the strip. The chain line 14 indicates a fold line extending transversely of the strip and of the leaflets 10. The line 14 is nearer to the right hand edge than to the left hand edge, by 10 mm in the instance. Three lines of adhesive 15 are placed on the front face of the right hand half of the strip, each line of adhesive overlapping the bottom edge 12 by a small margin. The left hand half of the leaflet strip is then folded over the right hand half about the fold line 14 so as to be adhered face-to-face with the right hand half by the three bands of adhesive 15. The 10 mm wide band 16 now projects beyond the underlying side edge 17 of the leaflet strip.

Figure 3:
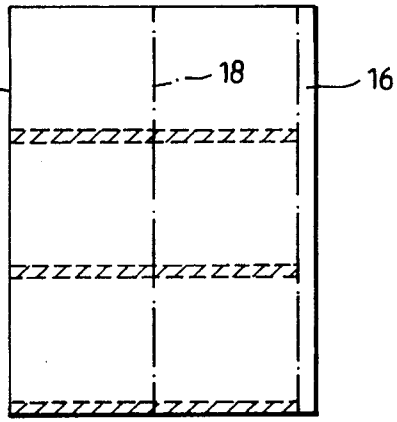

In the next operation, illustrated in FIG. 3, the folded edge along the line 14 is slit off and discarded and the two superimposed leaves thus formed are folded backward about a fold line 18 parallel to the fold line 14 so that one leaf encloses the other, leaving the band 16 still projecting to the right beyond the other parts of the leaflet strip.

Figure 4:
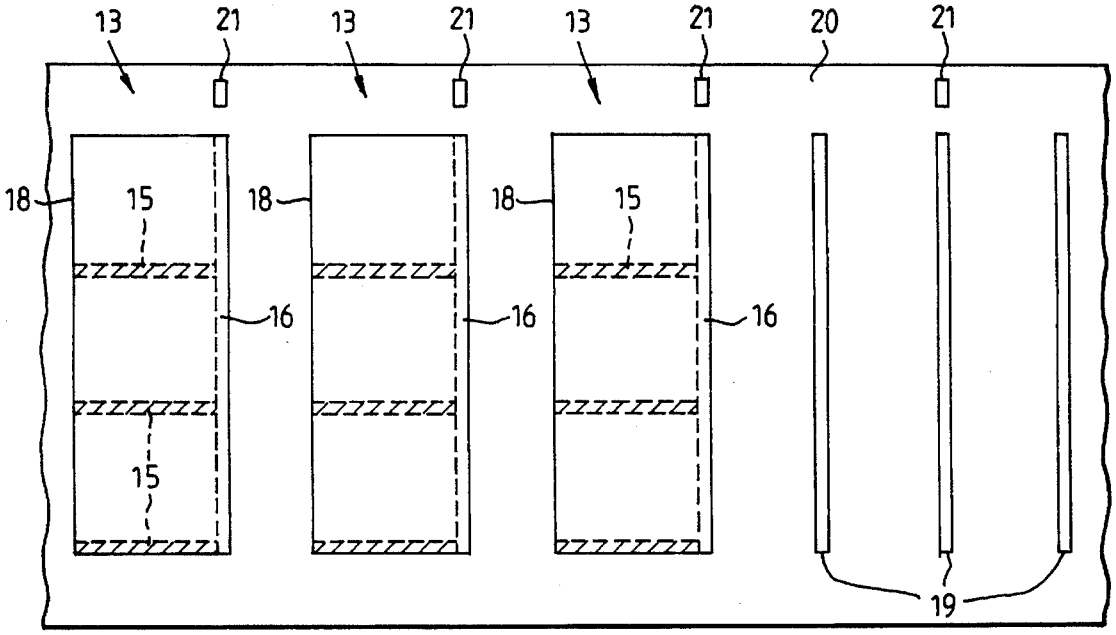

A series of folded leaflet strips 13 formed in this way are placed each on two parallel lines of adhesive 19 pre-printed on the front face of a web 20 of label material and extending transversely of the web as shown in FIG. 4. The label material has on its rear face a pressure-sensitive adhesive 8 protected by a release sheet 9 in the conventional manner. The band 16 is placed on one of the two lines of adhesive 19 and the part of the rear face of the leaflet strip adjoining the fold line 18 is placed on the other. Index marks 21 printed on the web enable the placement of the lines of adhesive to be controlled automatically and, if desired, enable the leaflet strips to be placed in their correct positions in relation to the lines of adhesive by automatic machinery.

Figure 5:
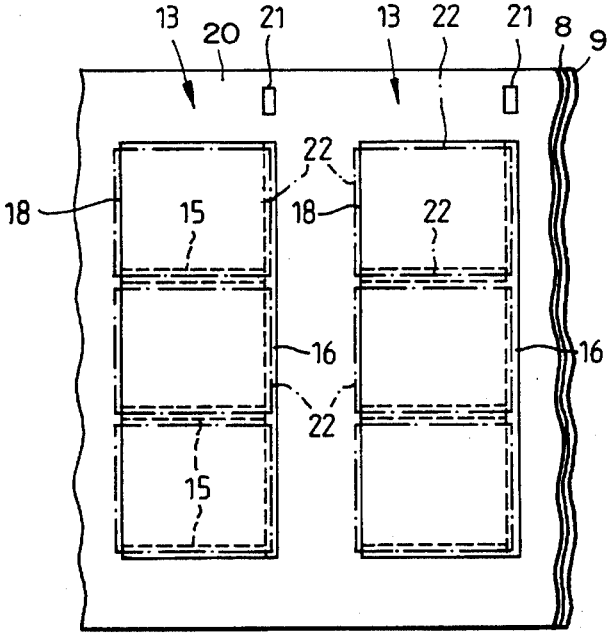
Figure 6:
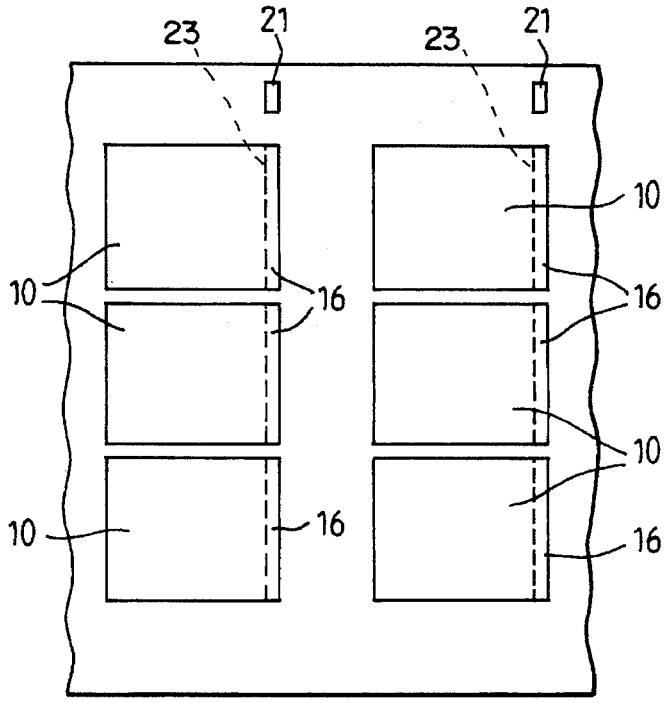

The index marks are also used at the next stage illustrated in FIG. 5. In this stage die-cutting apparatus (not shown) is employed to cut through to the release sheet 9 along the chain line 22 shown around each label/leaflet. This leaves each leaflet with its fold line 18 intact and with a part of the band 16. A thin line from the top edge of the band of adhesive 15 is left along the bottom edge of each leaflet. The waste material including the remainder of the band 15 is then removed in the conventional manner. This leaves rows of three label/leaflets extending across the width of the release sheet 9 as shown in FIG. 6.

The web can then be slit lengthwise to provide three strips each with a series of label/leaflets spaced along its length for use in automatic label-applying machinery.

Figure 7:
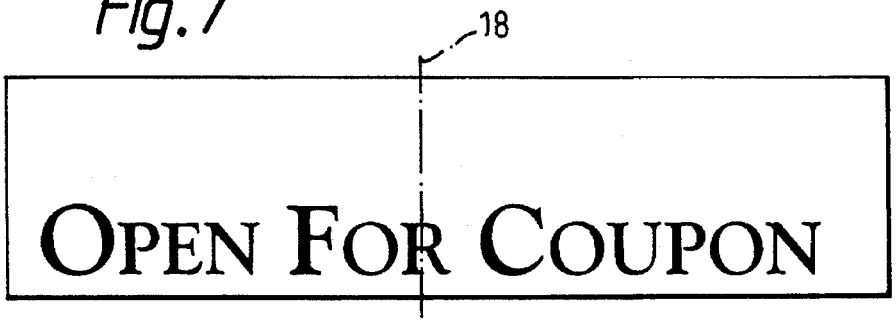
FIGS. 7 and 8 illustrate the opening of a leaflet
Figure 8:
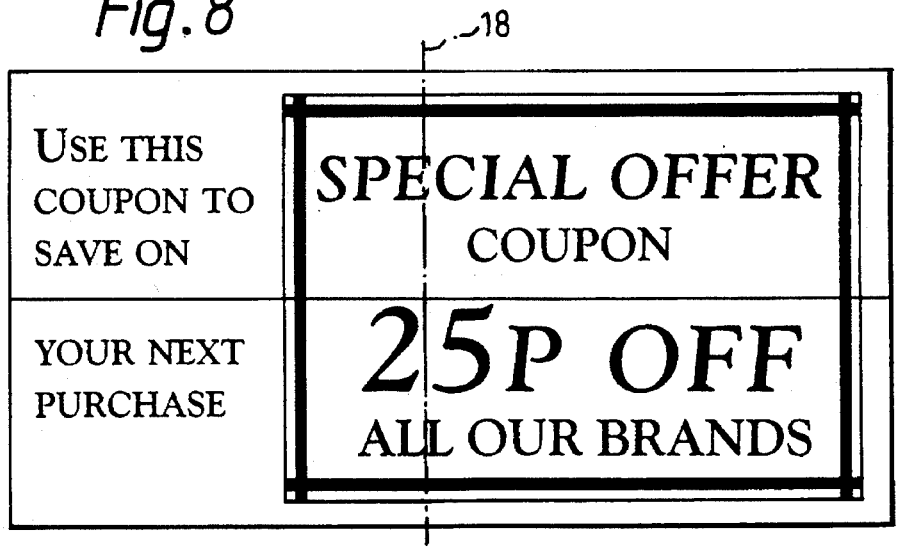

A line of perforations 23 may advantageously be initially formed adjacent the band 16 to facilitate opening of the leaflet. When the cover sheet of the leaflet is torn away from the band 16, the leaflet can be unfolded about the fold line 18 and then unfolded downwards about a hinge line formed by the line of adhesive along the bottom edge 12 of the leaflet. Owing to the way in which the leaflet is printed, a complete image and/or message is formed. FIGS. 7 and 8 illustrate the two successive stages of opening the leaflet.

If more space is required in a leaflet of a given overall folded size, the printed sheet may be extended to provide additional pairs of panels 5, 6 and so on, the two panels of each such pair being formed at opposite ends of the strip shown in FIGS. 1A and 1B, and the bands of adhesive 15 are appropriately extended. The extended sheet is folded about additional transverse fold lines 18*a*, 18*b* and so on extending parallel to fold line 18.

Figure 9:
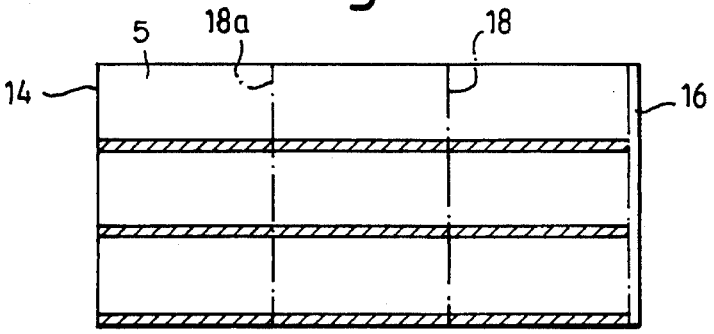
FIGS. 9 to 11 illustrate an extended form of label/leaflet according to the invention.
Figure 10:
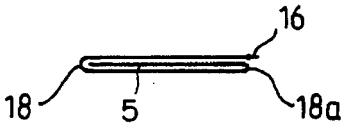
Figure 11:
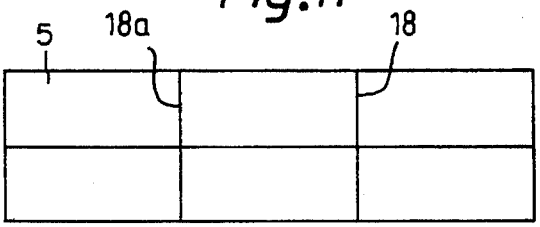

FIGS. 9, 10 and 11 respectively show diagrammatically, for a six-panel leaflet, a blank folded about the first fold line 14, the manner of folding the blank about the fold lines 18 and 18*a* to form a flat spiral, and the resulting leaflet when fully opened out.

Figure 12:
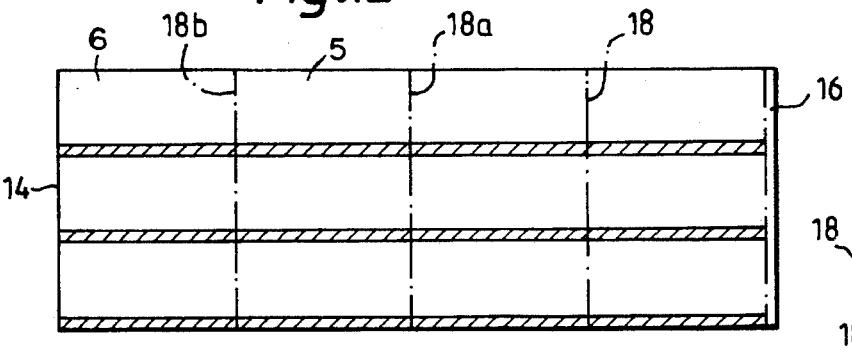
FIGS. 12 to 14 illustrate a further extended form of label/leaflet according to the invention.
Figure 13A:
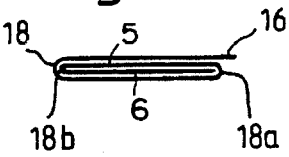
Figure 13B:
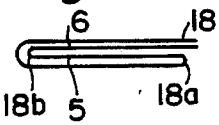
Figure 14:
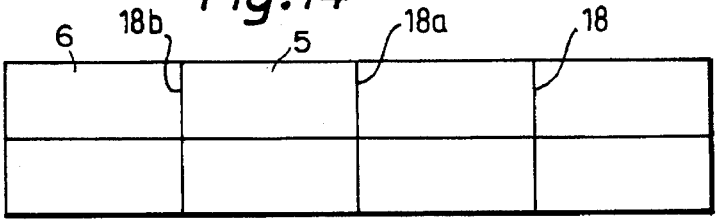

Similarly FIGS. 12, 13 and 14 respectively show diagrammatically, for an eight-panel leaflet, a blank folded about the first fold Line 14, the manner of folding the blank about the fold lines 18, 18*a* and 18*b* to form a flat spiral (FIG. 13A), and the leaflet when fully opened out.

The additional panels 5, 6 may alternatively be folded in zig-zag fashion, and can if desired be disposed between the rear cover panel and the carrier sheet 20. It is however preferred to employ the flat spiral form disposed between the cover and rear panels (FIG. 13B).

In a modified form, instead of providing the band 16, the cover panel is made to extend beyond the underlying panels and has an additional panel connected to it along a further fold line at its edge remote from the fold line 18 and folded behind the cover panel. The near face of the additional panel is bonded to the adhesive strip on the label material adjacent the further fold line, so that the cover panel is indirectly secured to the label material to prevent the leaflet from falling open.

The term bonding is used herein to include welding (for example in the case of plastic leaflets), adhesive, and crimping (which is a form of mechanical bonding of sheets by way of a band of sharp indentations locking two or more sheets together), If desired, the band 16 may be re-sealably adherent to the carrier label.

Other means of securing the leaflets to the label material may be employed. For example a web of transparent plastics material may be disposed over and adhered no the leaflet strips and the exposed parts of the label material, and a margin of this material may be left extending beyond the ends of each leaflet in the die-cutting stage, thus securing the leaflet to the label material.

I claim:

1. A leaflet comprising: a first sheet having a first fold line extending transversely of the sheet about which fold line the first sheet is folded to provide a cover panel and a rear panel, the cover panel having a surface exposed at a front side of the leaflet, and the rear panel having a surface exposed at a rear side of the leaflet, said surfaces being located on opposite sides of said first fold line from one another; and a second sheet having a second fold line extending transversely thereof, the second sheet being folded about itself at said second fold line, the folded second sheet being enclosed between the cover and rear panels of the first sheet and with the fold line of the second sheet adjacent the fold line of the first sheet, the two folded sheets being secured together face to face along one edge of the leaflet extending in a direction away from the fold lines.

2. A leaflet/label comprising: a carrier sheet having front and rear faces, with adhesive on said rear face; a release sheet protectively covering the adhesive; and a leaflet attached to said front face, said leaflet comprising a first sheet having a first fold line extending transversely of the first sheet about which fold line the first sheet is folded to provide a cover panel and a rear panel, the cover panel having a surface exposed at a front side of the leaflet, and the rear panel having a surface exposed at a rear side of the leaflet, said surfaces being located on opposite sides of said first fold line from one another, each of said panels having transversely extending ends one of which ends is adjacent the first fold line and the other of which ends is remote from the first fold line, and a second sheet having a second fold line extending transversely thereof, the second sheet being folded about itself at said second fold line, the folded second sheet being enclosed between the cover and rear panels of the first sheet and with the fold line of the second sheet adjacent the fold line of the first sheet, the two folded sheets being secured together face to face along one edge of the leaflet extending in a direction away from the fold lines; and securing means for securing the transversely extending ends of the cover panel to the carrier sheet such that the leaflet is held closed.

3. A leaflet/label as claimed in claim 2, wherein said first and second sheets have further transverse fold lines to form further panels disposed between the cover and rear panels or between the rear panel and the carrier sheet.

4. A leaflet/label as claimed in claim 3, wherein said first and second sheets are folded in a zig-zag fashion such that said further panels are disposed between the cover panel and the rear panel.

5. A leaflet/label as claimed in claim 3, wherein said first and second sheets are folded in the form of a flattened spiral such that said further panels are disposed between the cover panel and the rear panel.

6. A leaflet/label as claimed in claim 2, wherein said securing means comprises a bonding connection between the carrier sheet and at least the end of the rear panel adjacent said first fold line.

7. A leaflet/label as claimed in claim 2, wherein the end of the cover panel remote from the first fold line projects beyond said rear panel, said second sheet and any further panels disposed between the cover and the rear panels, and said securing means comprises a bonding connection between the carrier sheet and the end of the cover panel which projects beyond the rear panel, said second sheet and any further panels disposed between the cover and rear panels.

8. A leaflet/label as claimed in claim 2, and further comprising an additional panel connected to said cover panel along a transverse fold line remote from said first fold line and which additional panel is disposed underneath the cover panel, the cover panel and said additional panel extending beyond the rest of the leaflet in a direction away from said first fold line, and wherein said securing means comprises a bonding connection between the carrier sheet and said additional panel at a location adjacent the fold line between the cover panel and said additional panel.

9. A method of making a leaflet/label, said method comprising: folding a printed leaflet along a transverse first fold line intermediate its ends to form two parts of the leaflet on opposite sides of the fold line, bonding the two parts of the leaflet together face to face along one edge extending at right angles to the fold line, slitting the printed leaflet along the first fold line, folding the two parts along a second fold line parallel to where the first fold line existed to form a first folded sheet comprising cover and rear panels enclosing a second folded sheet, and attaching the leaflet to a face of a carrier label.

10. A method as claimed in claim 9, wherein the leaflet is attached to said face by attaching the first folded sheet at a location adjacent the second fold line to the face of the carrier label, and securing an end of the cover panel which has the second folded sheet between it and the carrier label, which end of the cover panel is remote from the second fold line, to the face of the carrier label such that the leaflet is held closed.

11. A method of producing a plurality of leaflet/labels mounted on a release sheet, said method comprising: making a strip of leaflets by folding a leaflet sheet along a first fold line transverse of its length, and which sheet has at least two parallel bands of bonding extending from the first fold line to at least one transverse edge of the leaflet sheet, to form two leaves bonded together face to face by the bands of bonding, the leaflet sheet having been pre-printed such that each of said leaflets has printed information disposed between an adjacent pair of said parallel bands or between one of said bands and a parallel edge of the leaflet sheet, cutting the leaflet sheet along the first fold line, folding the two leaves along a second fold line parallel to where the first fold line existed so that one of the folded leaves encloses the other, thereby forming a resulting strip of leaflets having a folded end at said second fold line, an enclosing leaf including a cover panel, and another leaf covered by the cover panel of the enclosing leaf, placing the resulting strip of leaflets on a front face of a strip of label material with said another leaf located between the cover panel and said front face, the label material also having a rear face supporting a pressure sensitive adhesive protected by the release sheet, bonding the folded end of the strip of leaflets to the front face of the label material and bonding a first end of the cover panel of the enclosing leaf, which first end is remote from the second fold line, to the front face of the label material such that the leaflets are held enclosed, die-cutting around each of the leaflets as far as the release sheet in such a manner that said leaflets each include along only one edge thereof a line of bonding from said bands, respectively, and discarding waste material produced by said die-cutting around each of the leaflets.

12. A method as claimed in claim 11, wherein the strip of leaflets is placed to extend transversely of the strip of label material.

13. A method as claimed in claim 12, wherein said first end of the cover panel extends beyond parts of the strip of leaflets underlying said cover panel, and wherein said bonding comprises bonding said first end of the cover panel and the folded end of the strip of leaflets to the front face of the strip of label material along lines extending transversely of the strip of label material.

* * * * *